United States Patent [19]

Woods, I et al.

[11] Patent Number: 4,567,337

[45] Date of Patent: Jan. 28, 1986

[54] FLEXIBLE EXTENSION DEVICE FOR TOGGLE SWITCHES

[76] Inventors: Karl E. Woods, I, 625 Cincinnati St., Toledo, Ohio 43611; Evan Scott, Jr., 822 Anderson St., Northwood, Ohio 43619

[21] Appl. No.: 568,031

[22] Filed: Jan. 3, 1984

[51] Int. Cl.[4] ..... H01H 3/04
[52] U.S. Cl. ..... 200/331
[58] Field of Search ..... 200/331, 330, 332, 338

[56] References Cited

U.S. PATENT DOCUMENTS

| | | | |
|---|---|---|---|
| 519,354 | 5/1894 | Sheppard | 200/331 |
| 1,650,348 | 11/1927 | Hanny | 200/332 |
| 2,231,072 | 2/1941 | Jackson | 200/332 |
| 2,580,905 | 1/1952 | Foster | 200/331 |
| 2,726,303 | 12/1955 | Berndsen | 200/331 |
| 3,581,037 | 5/1971 | Schiffelbein | 200/331 |
| 4,256,943 | 3/1981 | Whitlock | 200/331 |
| 4,291,212 | 9/1981 | Bui | 200/331 |
| 4,419,556 | 12/1983 | Hare | 200/331 |

FOREIGN PATENT DOCUMENTS

| | | | |
|---|---|---|---|
| 265214 | 7/1970 | U.S.S.R. | 200/331 |

*Primary Examiner*—Stephen Marcus
*Assistant Examiner*—Renee S. Kidorf
*Attorney, Agent, or Firm*—David D. Murray

[57] ABSTRACT

A light switch extension for use with a conventional toggle type wall switch permits ready on and off operation of the switch by children, handicapped individuals and others. The extension includes a flexible component which engages the light switch toggle at least on the upper and lower surfaces thereof and is secured there by a pin passing through the toggle or by alternate devices such as cooperating bosses and recesses. The flexible component is secured to a vertically depending operator assembly by a suitable fastener such as a screw or by other agencies such as an adhesive. A first portion of the operator assembly is a rigid rod and the second portion is a flexible element such as a helical spring which is capable of axially transmitting sufficient force to the flexible component and switch toggle to turn it on and off but which is radially or laterally flexible such that radially or laterally applied forces will harmlessly deflect it.

12 Claims, 6 Drawing Figures

FLEXIBLE EXTENSION DEVICE FOR TOGGLE SWITCHES

BACKGROUND OF THE INVENTION

The invention relates generally to a convenience device for use with electrical switches and more specifically to a light switch extension which permits operation of wall mounted light switches by children, handicapped individuals and others.

While the average person thinks little of the simple operation of activating or deactivating a wall mounted light switch, for people unable to readily reach or grip the relatively small switch toggle this operation can be a source of frustration or may be simply an impossibility. Frequently, too, an individual having no such routine difficulty may be burdened with packages and the like and find it inconvenient or again impossible to operate a conventional light switch.

Inventors have acknowledged these difficulties. Many have produced devices directed to the solution of this problem and have obtained patents thereon. For example, U.S. Pat. Nos. 2,692,932, 2,726,303 and 3,581,037 all disclose devices intended to facilitate the operation of light switches by the aforementioned individuals. The foregoing group of patents disclose toggle switch extension which include a cap or similar structure which fits over the switch toggle and a set screw or similar threaded securement means which attaches the cap to the toggle switch.

U.S. Pat. Nos. 2,719,898 and 3,142,744 teach similar devices which appear to include caps which simply slip over the switch toggle and are retained there by such means as corrugated jaws or an adhesive which is spread within the toggle receiving cavity. U.S. Pat. Nos. 2,580,905 and 3,175,420 include rigid handle and clevis structures which are secured to the sides of the switch toggle along a horizontal axis. U.S. Pat. Nos. 3,121,778 and 3,188,439 teach devices wherein guide means are installed on the toggle switch plate such that the switch extension is constrained to move bi-directionally along a vertical axis.

A review of such prior art devices reveals various complexities apparently believed necessary to perform a relatively simple task. Furthermore the foregoing patents all disclose vertically extending switch extensions which are fabricated of a rigid or substantially rigid material. That is, the vertically depending force transmitting member is not flexible and thus may damage the switch toggle if it is inadvertently deflected or twisted laterally.

From the foregoing patents and discussion, it is apparent that improvements in the art of toggle switch extensions are both desirable and possible.

SUMMARY OF THE INVENTION

The instant invention relates to a light switch extension for assembly and use with a conventional toggle type wall switch. The light switch extension permits ready and simple operation of the switch by children, handicapped individuals and others for which the switch, given its standard position—approximately four feet above the floor—may be difficult or impossible to reach and operate. The light switch extension includes a flexible engagement component which engages at least the upper and lower surfaces of the light switch toggle and which may be secured in such engagement by a suitable pin passing through the toggle. Alternate means of securement include cooperating bosses and recesses. The flexible component may also define a cavity which surrounds a switch toggle generally on all four sides and which may be secured thereto, if desired, by various fastening means. The flexible component is secured to a depending operator assembly by a suitable fastener such as a screw. Alternatively, the flexible component and a portion of the vertically depending operator assembly may be fabricated as an integral unit. A first portion of the operator assembly is a rigid elongate structure and the second portion is a flexible elongate structure such as a tension spring or similar structure which is capable of axially, bi-directionally transmitting sufficient force to the flexible component and switch toggle to turn the switch on and off. The flexible structure, however, is of such a design that it may be flexed and deformed radially such that the application of such force will not damage the switch or any associated instrumentality.

It is thus an object of the instant invention to provide a device for use with wall switches and the like which facilitates ready and simple control of a light switch by children and other individuals unable to reach the light switch.

It is a further object of the instant invention to provide a light switch extension wherein a vertically depending operator assembly comprises a first elongate rigid member and a second flexible member which is nonetheless capable of transmitting sufficient axial force to actuate the light switch.

It is a still further object of the instant invention to provide a light switch extension which is inexpensive, durable and which overcomes various shortcomings of prior art devices.

Further objects and advantages of the instant invention will become apparent by reference to the following description of the preferred and alternate embodiments as well as reference to the appended drawings.

DESCRIPTION OF THE PREFERRED EMBODIMENT

Figure 1:
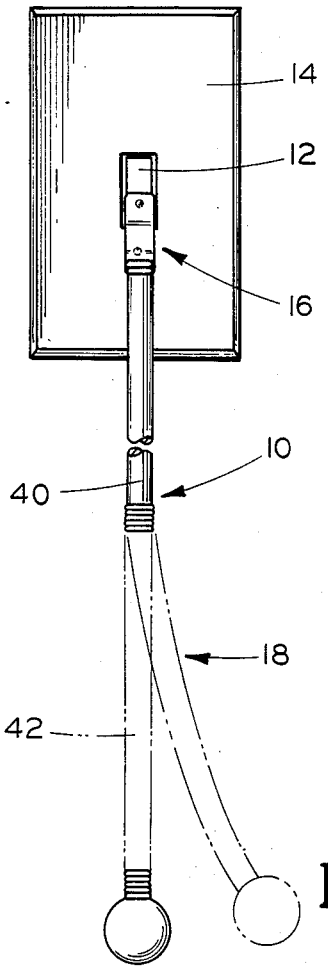
FIG. 1 is a front elevational view of a light switch extension according to the instant invention illustrating a portion of the operator assembly in a deflected condition in phantom lines.
Figure 2:
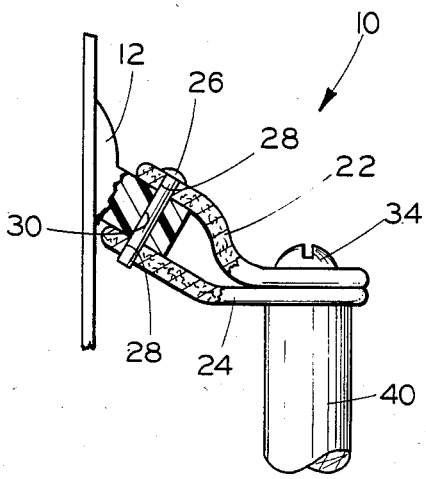
FIG. 2 is an enlarged, side elevational view with portions broken away of a light switch extension according to the instant invention.

Referring now to FIGS. 1 and 2, a preferred embodiment of the light switch extension according to the instant invention is illustrated and generally designated by the reference numeral 10. The light switch extension 10 is intended for use with a conventional wall switch having a switch toggle 12 which is generally mounted behind and protected by an escutcheon or wall plate 14. Typically such toggle switches 12 and wall plates 14 are disposed approximately four feet above the floor of the room in which they are disposed. As such, the switch toggle 12 may be beyond the reach of small children, and other individuals as above noted. The light switch extension 10 includes an engagement assembly 16 and an operator assembly 18. The engagement assembly 16 may take different forms as described subsequently with regard to the first and second alternate embodiments. The operator assembly 18 likewise is susceptible to variation and these will also be described below.

The engagement assembly 16 preferably includes flexible leaves or straps 22 and 24; the first strap 22 disposed adjacent and extending out from the upper surface of the switch toggle 12 and the second strap 24 disposed adjacent and extending out from the lower surface thereof. The first and second straps 22 and 24, respectively, are preferably fabricated of any suitable flexible but durable material such as leather, polyvinyl chloride, or an elastomer such as rubber. The straps 22 and 24 are secured to the toggle by means of a retaining pin 26 which is received within and passes through suitably sized openings 28 in the straps 22 and 24 as well as in and a through passageway 30 formed in the switch toggle 12. The retaining pin 26 may be a single cotter pin or any similar design retaining pin or pair of retaining pins wherein each pin is driven through one of the straps 22 and 24. The retaining pin 26 may be frictionally received within the aperture 30 of the switch toggle 12 and thereby retain the straps 22 and 24 as illustrated. If desired, the retaining pin 26 may be fabricated of an insulating material such as plastic, bakelite, polystyrene and the like. The ends of the straps 22 and 24 opposite the switch toggle 12 are disposed in general alignment and juxtaposition and secured to the operator assemby 18 by any suitably fastening means such as a screw 34 or rivet or other mechanical fastener. Alternatively, a suitable adhesive may be utilized.

The operator assembly 18 includes a rigid upper portion 40. The upper portion 40 may be an elongate rod of any convenient cross-section, but is preferably circular. It may define a length of between six inches and one foot approximately and may be fabricated of wood or plastic. The operator assembly 18 further includes a flexible portion 42 which may likewise extend over a vertical length of between approximately six inches and one foot. The flexible lower portion 42 may be fabricated of a helically wound spring material to preferably form a tightly wound elongate tension spring or similar device capable of transmitting upward force in compression to the engagement assembly 16 and switch toggle 12 without significant lateral deformation and transmitting downward force in tension to the same mechanism without significant axial deformation. Preferably, a resilient cap or ball 44 is secured to the lower terminus of the flexible lower portion 42 as illustrated by any suitable fastening means such as adhesive. The ball 44 may be readily gripped or pushed by the palm of the hand to facilitate operation of the switch toggle 12.

Figure 3:
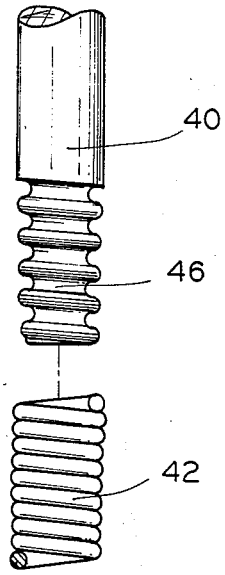
FIG. 3 is an enlarged, exploded, fragmentary elevational view of a portion of the operator assembly according to the instant invention.

Referring now to FIG. 3, a preferred manner of interconnecting the rigid upper portion 40 and flexible lower portion 42 of the operator assembly 18 is illustrated. The lower terminus of the rigid upper portion 40 may be formed with male threads 46 which are complementary to and seat within the interior region of the flexible lower portion 42. As noted, the flexible lower portion 42 is preferably fabricated of a helically wrapped spring wire and thus the male threads 46 may be conveniently and expeditiously threaded into the flexible lower portion 46 to tightly secure the rigid upper portion 40 and flexible lower portion 42 together. Alternatively, any convenient fastening means such as tacks, staples or an adhesive may be utilized, with or without the threads 46, to secure the components together.

Figure 4:
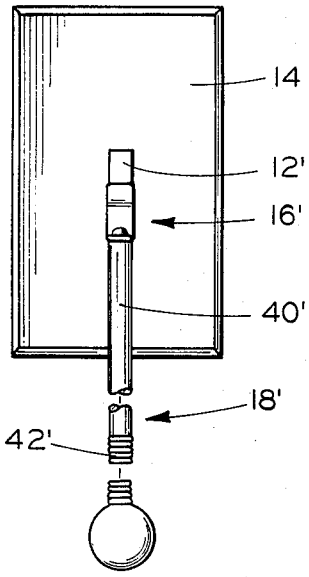
FIG. 4 is a front elevational view of an alternate embodiment of a light switch extension according to the instant invention.
Figure 5:
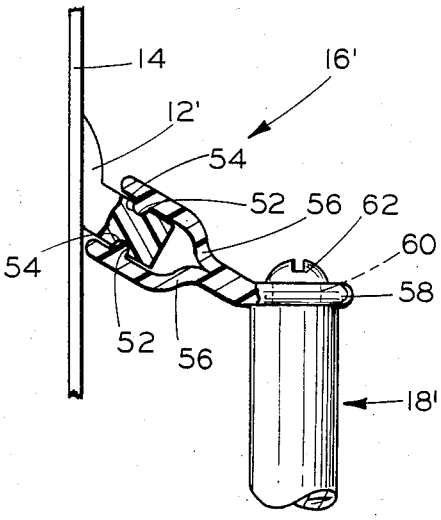
FIG. 5 is an enlarged, side elevational view with portions broken away of an alternate embodiment light switch extension according to the instant invention.

Referring now to FIGS. 4 and 5, a first alternate embodiment of the instant invention is illustrated. Here, a switch toggle 12' includes a pair of aligned recesses or depressions 52 formed in its upper and lower surfaces. The first alternate embodiment of the engagement assembly 16' includes bosses 54 which are formed as integral portions of a pair of opposed parallel fingers or tabs 56. The bosses 54 are received within a respective one of the depressions 52 in the switch toggle 12'. The fingers or tabs 56 blend into a unitary terminal or base portion 58 having an aperture 60 which receives a fastener such as a screw 62. The screw 62 secures the engagement assembly 16' to an the operator assembly 18' in which may be in all respects identical to that described with regard to the preferred embodiment as will be readily apparent. The engagement assembly 16' of the first alternate embodiments may preferably be formed of a rigid material such as polyvinyl chloride or other plastic or similar material which will maintain the shape of the fingers or tabs 56 such that the bosses 54 will remain engaged within the depressions 52 of the switch toggle 12' and provide proper operation. Sufficient flexibility of the engagement assembly 16', however, must also be exhibited such that the operator assembly 18' will remain in a generally depending orientation as illustrated regardless of the position of the switch toggle 12'. It will be appreciated that the first alternate embodiment of engagement assembly 16' is of unitary construction and therefore especially easy to fabricate and is exceptionally easy to install.

Figure 6:
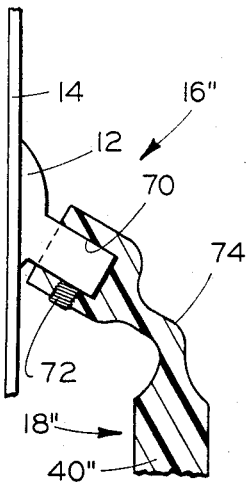
FIG. 6 is a side elevational view in partial section of a second alternate embodiment of a light switch extension according to the instant invention.

With reference now to FIG. 6, a second alternate embodiment of the engagement assembly 16'' is illustrated. Here, the engagement assembly 16'' is a unitary component having a cavity 70 which seats about the switch toggle 12 and is retained there by a set screw 72 or by similar means such as adhesive or resilient gripping means. The engagement assembly 16'' also includes a narrow neck region 74 which interconnects the portion of the engagement assembly 16'' secured to the switch toggle 12 with a downwardly depending region which may be a portion of an upper rigid portion 40'' of an operator assembly 18''. The neck region 74 also provides a flexible interconnection in order that the operator assembly 18 may hang in a substantially vertical orientation as noted above. Finally, it is preferable that the lower terminal portion of the upper portion 40'' of the second alternate embodiment of the operator assembly 18'' include a threaded portion such as a threaded portion 46 illustrated in FIG. 3 to facilitate securement of a flexible portion thereto similar to the flexible portion 42 illustrated in FIGS. 2 and 3.

The foregoing disclosure is the best mode devised by the inventors for practicing this invention. It is apparent, however, that apparatus incorporating modifications and variations will be obvious to one skilled in the art of switch operators. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

We claim:

1. A light switch extension for facilitating operation of a toggle type wall switch comprising, in combination, means for engaging the switch toggle of a wall switch, said engaging means including a first flexible strap having a first surface for disposition against an upper surface of such toggle, a second flexible strap having a second surface generally parallel to said first surface for disposition against a lower surface of such toggle, means for retaining said engaging means on said toggle, said retaining means defining a first axis disposed normal to said first and said second surfaces, said engaging means further including a terminal portion and a flexible intermediate portion disposed between said first and second surfaces and said terminal portion, and an elongate operator means coupled to said terminal portion for applying bi-directional force to such toggle, said operator means including a rigid portion and a helical spring coupled to said rigid portion and defining a second axis for bi-directionally transferring forces applied substantially along said second axis and deforming in response to forces applied obliquely and perpendicularly to said axis.

2. The light switch extension of claim 1 wherein said retaining means includes at least one member extending into such switch toggle.

3. The light switch extension of claim 2 wherein said straps are fabricated of leather.

4. The light switch extension of claim 1 wherein said retaining means includes a set screw means for engaging such switch toggle.

5. The light switch extension of claim 1 wherein said rigid portion includes complementary helical threads for engagement with said spring.

6. A flexible light switch extension for facilitating operation of a toggle type wall switch comprising, in combination, an engagement means for securement to the toggle of a switch, said engagement means including a first flexible member for disposition against one surface of such toggle, a second flexible member for disposition against an opposed surface of such toggle, said first and said second flexible members secured to such toggle at substantially colinear sites by at least one retaining member extending into such toggle, said first and said second flexible members extending away from such switch toggle and merging into intimate juxtaposition to form a terminal portion and an elongate operator means coupled to said terminal portion for applying bi-directional force to such toggle, said operator means including a rigid portion and a flexible helical spring portion coupled to said rigid portion and defining an axis for bi-directionally transferring forces applied substantially along said axis and deforming in response to forces applied obliquely and perpendicularly to said axis.

7. The flexible light switch extension of claim 6 wherein said first and second flexible members are fabricated of leather.

8. The flexible light switch extension of claim 6 wherein said first and second flexible members are fabricated of polyvinyl chloride.

9. The flexible light switch extension of claim 6 wherein such switch toggle defines a through aperture and said retaining member is a pin extending through said aperture.

10. The flexible light switch extension of claim 6 wherein such switch toggle defines a pair of colinear recesses disposed on opposite sides of such switch toggle for receiving a respective said retaining member.

11. The flexible light switch extension of claim 6 wherein said rigid portion includes complementary helical threads for engagement with said spring.

12. The flexible light switch extension of claim 6 further including a ball secured to the end of said flexible portion means opposite said rigid portion.

* * * * *